US011344132B2

(12) United States Patent
Weibel et al.

(10) Patent No.: US 11,344,132 B2
(45) Date of Patent: May 31, 2022

(54) ADJUSTABLE BED WITH LOAD DISTRIBUTION BRACKET

(71) Applicant: L&P PROPERTY MANAGEMENT COMPANY, South Gate, CA (US)

(72) Inventors: Daniel J. Weibel, Carl Junction, MO (US); Scott Washburn, Carthage, MO (US); Von W. Brottlund, Pierce City, MO (US)

(73) Assignee: LEGGETT & PLATT, INC., South Gate, CA (US)

( * ) Notice: Subject to any disclaimer, the term of this patent is extended or adjusted under 35 U.S.C. 154(b) by 148 days.

(21) Appl. No.: 16/355,992

(22) Filed: Mar. 18, 2019

(65) Prior Publication Data

US 2020/0297125 A1 Sep. 24, 2020

(51) Int. Cl.

| | |
|---|---|
| ***A47C 20/04*** | (2006.01) |
| ***A47C 19/04*** | (2006.01) |
| ***A61G 7/015*** | (2006.01) |
| ***A47C 19/02*** | (2006.01) |

(52) U.S. Cl.

CPC ..... *A47C 20/041* (2013.01); *A47C 19/045* (2013.01); *A47C 20/048* (2013.01); *A47C 19/025* (2013.01); *A61G 7/015* (2013.01)

(58) Field of Classification Search

CPC ... A47C 20/041; A47C 19/045; A47C 20/048; A47C 19/025; A47C 20/00; A61G 7/015; A61G 7/018

See application file for complete search history.

(56) References Cited

U.S. PATENT DOCUMENTS

| | | | | |
|---|---|---|---|---|
| 5,161,274 | A * | 11/1992 | Hayes | A47C 20/041 5/616 |
| 9,986,844 | B2 * | 6/2018 | Shih | A47C 21/026 |
| 2017/0112716 | A1 * | 4/2017 | Rawls-Meehan | A61G 7/015 |

FOREIGN PATENT DOCUMENTS

| | | | | |
|---|---|---|---|---|
| CN | 208159710 | * | 11/2018 | A01K 1/03 |

* cited by examiner

*Primary Examiner* — David R Hare
*Assistant Examiner* — Madison Emanski
(74) *Attorney, Agent, or Firm* — Shook Hardy & Bacon, L.L.P.

(57) ABSTRACT

A bracket is provided for an adjustable bed base that distributes the load of an actuator across a moveable panel of the adjustable bed. The bracket is coupled to a moveable panel of the adjustable bed, and has a width that is greater than one-third the width of the moveable panel.

13 Claims, 5 Drawing Sheets

ADJUSTABLE BED WITH LOAD DISTRIBUTION BRACKET

TECHNICAL FIELD

Embodiments of the present invention relate to adjustable bed supports and particularly to an adjustable bed having one or more load distribution brackets.

BACKGROUND OF THE INVENTION

In the motion bedding industry, adjustable bed bases exist to move portions of a bed, such as the head area, or the lower leg and thigh area, to increase the comfort of the users. In some existing adjustable bed bases, the actuators driving the support panels of the adjustable bed direct a force to a narrow area on the support panel. It would be helpful to distribute the load of the actuator driving the support panel across a greater area than in past adjustable bed bases. Further, it would be desirable to obscure from view the actuators as much as possible.

BRIEF DESCRIPTION OF THE INVENTION

A bracket is provided for use on a moveable panel of an adjustable bed. The bracket includes a first u-shaped member having a first leg separated from a second leg by a central section; and a second u-shaped member, inverted with respect to the first u-shaped member, and having first and second legs coupled to the central section of the first u-shaped member. In some embodiments, the bracket has a width that is greater than one-third the width of the moveable panel of the adjustable bed. In some embodiments, an adjustable bed base is provided comprising: a stationary base; a head panel moveable with respect to the stationary base; a head bracket coupled to the head panel, the head bracket comprising a first u-shaped member having a first leg separated from a second leg by a central section; and a second u-shaped member, inverted with respect to the first u-shaped member, and having a first leg coupled to the central section of the first u-shaped member and a second leg coupled to the central section of the first u-shaped member. In other embodiments, a bracket is provided for use on a moveable panel of an adjustable bed, the moveable panel having a first width, the bracket comprising: a w-shaped member having a second width, wherein the second width is greater than one-third the first width.

Additional objects, advantages, and novel features of the invention will be set forth in part in the description that follows, and in part will become apparent to those skilled in the art upon examination of the following, or may be learned by practice of the invention.

BRIEF DESCRIPTION OF SEVERAL VIEWS OF THE DRAWINGS

The present invention is described in detail below with reference to the attached drawing figures, wherein.

DETAILED DESCRIPTION OF THE INVENTION

Embodiments of the present invention generally relate to a bracket for use on a moveable panel of an adjustable bed, comprising: a first u-shaped member having a first leg separated from a second leg by a central section; and a second u-shaped member, inverted with respect to the first u-shaped member, and having first and second legs coupled to the central section of the first u-shaped member. In some embodiments, the bracket has a width that is greater than one-third the width of the moveable panel of the adjustable bed. In other embodiments, a bracket is provided for use on a moveable panel of an adjustable bed, the moveable panel having a first width, the bracket comprising: a w-shaped member having a second width, wherein the second width is greater than one-third the first width. In some embodiments, an adjustable bed base is provided comprising: a stationary base; a head panel moveable with respect to the stationary base; a head bracket coupled to the head panel, the head bracket comprising a first u-shaped member having a first leg separated from a second leg by a central section; and a second u-shaped member, inverted with respect to the first u-shaped member, and having a first leg coupled to the central section of the first u-shaped member and a second leg coupled to the central section of the first u-shaped member.

Figure 1:
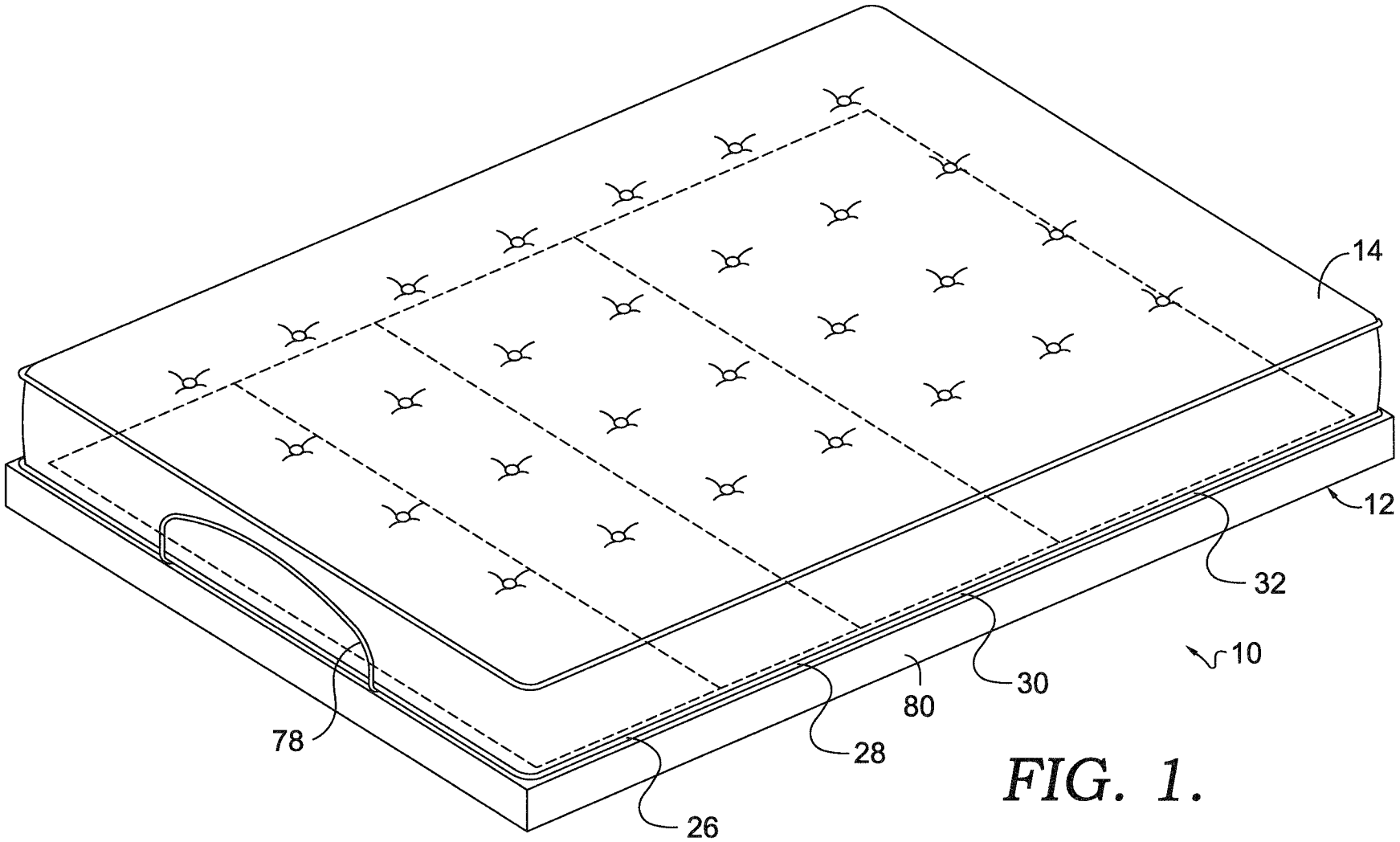
FIG. 1 is a perspective view of an exemplary adjustable bed with a mattress, in accordance with an embodiment of the invention.
Figure 2:
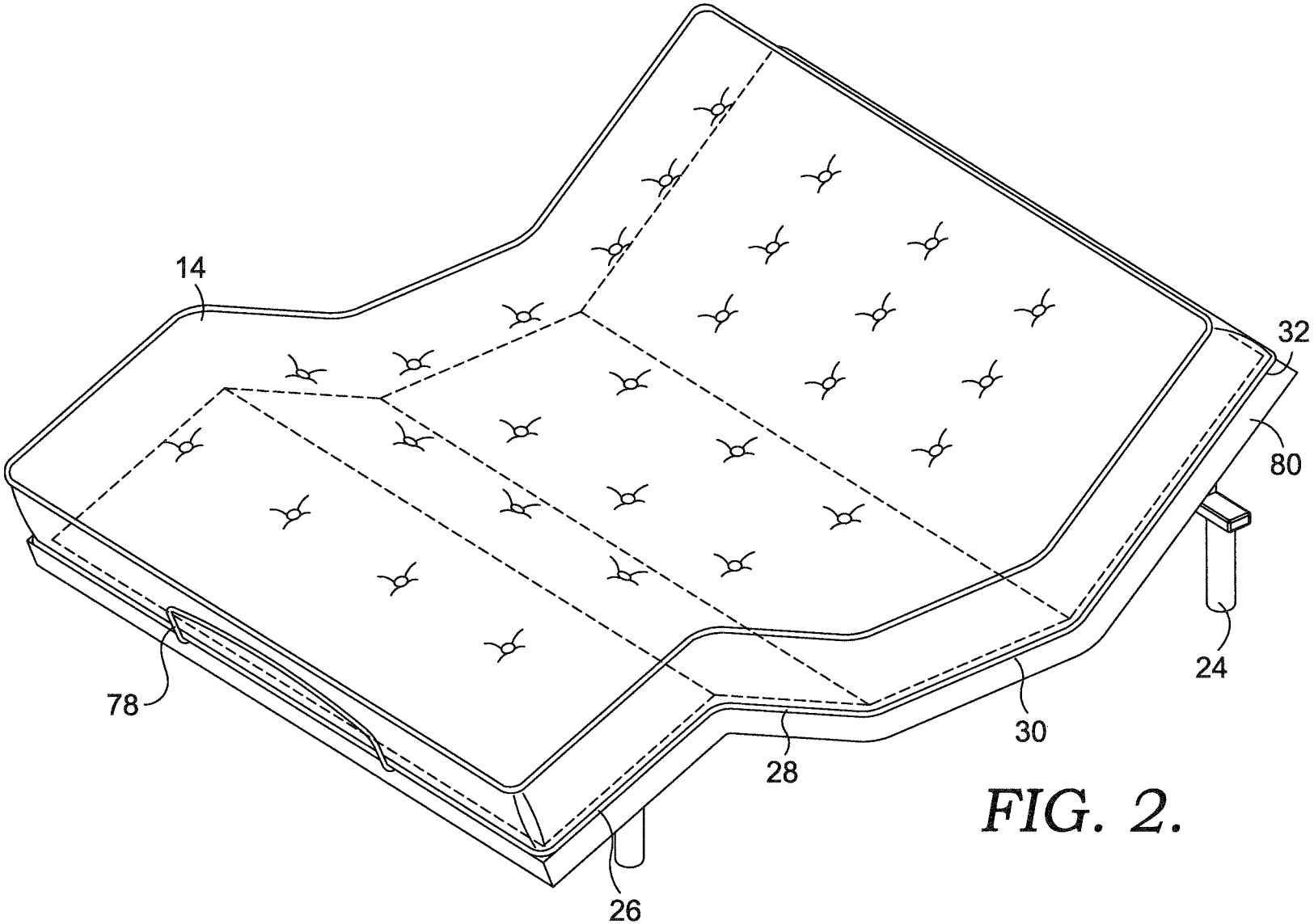
FIG. 2 is a view similar to FIG. 1, but showing the adjustable bed with portions moved to a raised position.

An adjustable bed 10 is shown in a flat position in FIG. 1. At a high-level, the adjustable bed 10 includes a base 12 and a mattress 14. The base 12 supports mattress 14 and is operable to move mattress 14 into a number of different positions. For example, the head area and the foot/thigh area may be raised to the position shown in FIG. 2.

Figure 3:
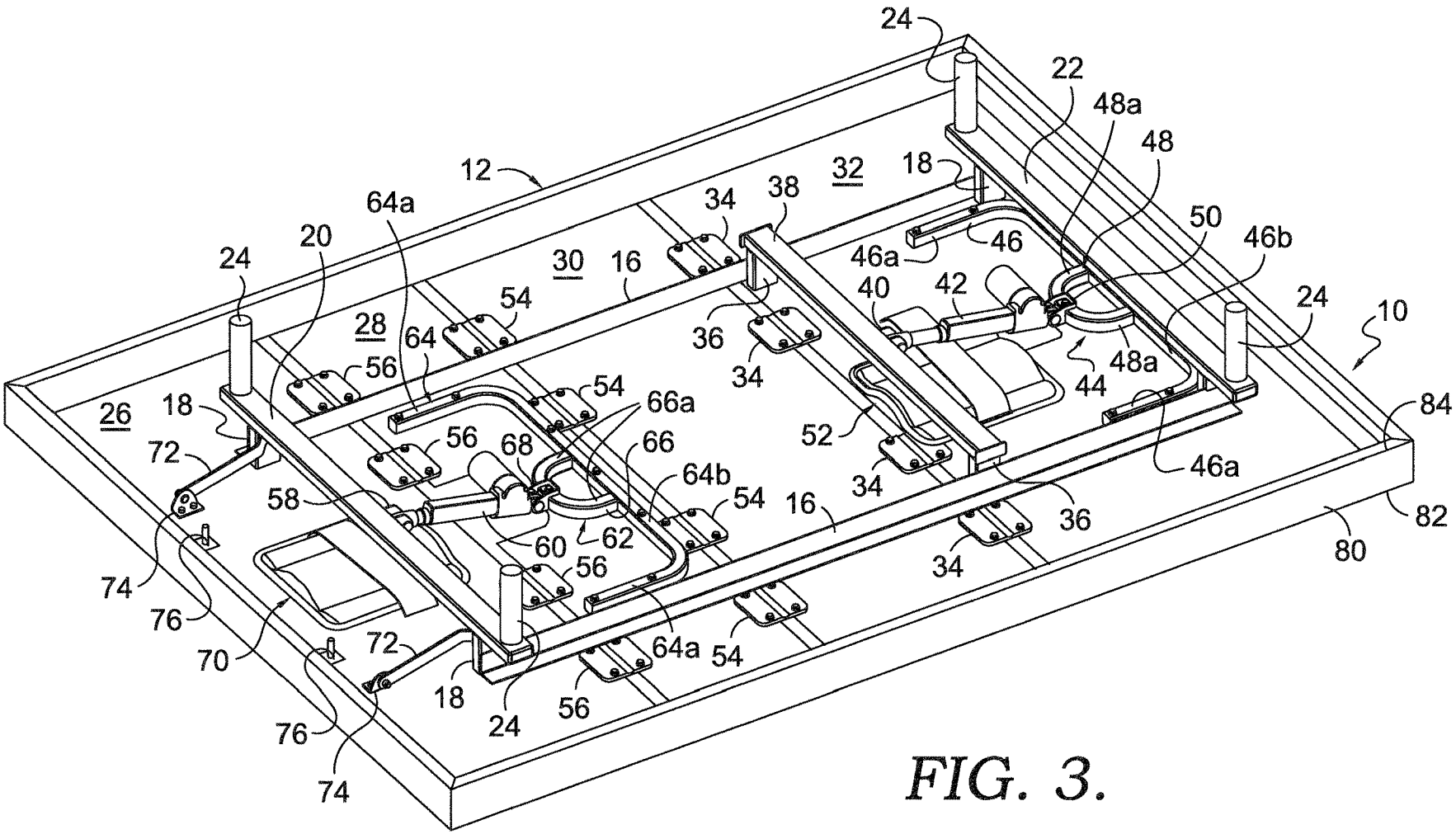
FIG. 3 is a bottom perspective view of the adjustable bed of FIG. 1.

FIG. 3 shows a perspective view of the underside of base 12. As shown, base 12 includes side rails 16 that are spaced apart, and parallel to one another. Side rails 16 can be formed, for example, from angled steel or other metals offering the needed support. One upright support 18 is coupled to each end of each side rail 16, such as by welding, bolts or other securing mechanisms. The uprights 18 can be formed, for example, from square steel tubing, although other materials could also be used. A foot cross member 20 is coupled to the uprights 18 on the foot end of the adjustable bed 10 and a head cross member 22 is coupled to the uprights 18 on the head end of the adjustable bed 10. Again, this coupling could be, for example, a weldment, and like uprights 18, the foot and head cross members 20, 22 could be formed from a square steel tubing. As shown, in FIG. 3, a number of legs 24 are coupled to the foot and head cross members 20, 22 to support the base 12 above a flooring surface. In some embodiments, the legs 24 are height adjustable. Each end of the foot and head cross members 20, 22 is fitted with an internal cage nut (not shown), that receives a threaded post on legs 24, such that legs 24 are coupled to the respective foot and head cross member 20, 22 by threading the post of the leg 24 into the internal cage nut.

The base 12 includes a number of panels that support the mattress 14. More specifically, the base 12 includes a foot panel 26, a thigh panel 28, a stationary panel 30 and a head panel 32. Each of the panels 26-32 are constructed with a firm, rigid material, such as plywood or a plastic material. The stationary panel 30 is coupled to each side rail 16, such as by bolting or other attaching mechanisms. In this way, stationary panel 30 does not move or articulate with respect to the side rail 16. Head panel 32 is coupled to stationary panel 30 with a number of hinges 34. As shown in FIG. 3, for example, four hinges 34 are used to couple one edge of stationary panel 30 to an adjacent edge of head panel 32. The hinges 34 allow head panel 32 to move (pivotally) with respect to stationary panel 30.

An additional upright support 36 is coupled to each side rail 16. In some embodiments, each upright support 36 is in line with the edge of head panel 32 that is adjacent stationary panel 30. Upright supports 36 are also coupled to a cross tube 38 that is similar to foot and head cross members 20, 22, but may only extend the width between the side rails 16, as shown. Cross tube 38 has a motor/actuator mount 40 coupled generally midway between the ends of the cross tube 38, such as by welding. Motor/actuator mount 40 supports one end of an actuator 42, and allows actuator 42 to pivot with respect to cross tube 38. The opposite end of actuator 42 is pivotally coupled to a bracket 44. More specifically, bracket 44, in some embodiments includes a shallow, u-shaped member 46, having two outer legs 46*a* coupled by a straight central section 46*b*. The u-shaped member 46 may be formed, for example, with bent, square steel tubing, or as a series of bent, square tubes welded in the shallow u-shape. The shallow u-shaped member 46 of bracket 44 is rigidly coupled to head panel 32, such as, for example, by bolts or screws. Bracket 44 also includes another u-shaped member 48 having two outer legs 48*a*, and inverted with respect to u-shaped member 46. U-shaped member 48 is coupled to u-shaped member 46 generally centered on central section 46*b* in the bottom of u-shaped member 46. U-shaped member 48 and u-shaped member 46 can be coupled together, in some embodiments, by welding to create bracket 44. The bottom center of u-shaped member 48 is coupled to a motor/actuator mount 50 that is, in turn, coupled to actuator 42. The configuration of cross tube 38, actuator 42 and bracket 44 allows a shallow angle for the actuator 42 to better obscure actuator 42 from view when the adjustable bed 10 is used. Additionally, bracket 44 distributes the force of actuator 42 across head panel 32 more evenly than would a more-direct (narrow) coupling of actuator 42 to head panel 32. In some embodiments, the width of bracket 44 is greater than one-third the width of, and approximately fifty percent the width of, head panel 32. While not shown, actuator 42 is coupled to a power supply and is typically controlled with some type of hand-held controller by the user, as would be understood by those of skill in the art. Additionally, the base 12 may include massage vibration in some embodiments, and may have a vibration motor (shown under a schematically depicted cover 52).

The edge of stationary panel 30 opposite that of head panel 32 is pivotally coupled to thigh panel 28 with a series of hinges 54, similar to hinges 34. Similarly, the adjacent edges of thigh panel 28 and foot panel 26 are pivotally coupled with a series of hinges 56. As best seen in FIG. 3, a motor/actuator mount 58 is rigidly coupled (such as by welding) to foot cross member 20, generally at the center of foot cross member 20. Motor/actuator mount 58 is used to pivotally couple one end of an actuator 60 to foot cross member 20. The opposite end of actuator 60 is pivotally coupled to a bracket 62. In some embodiments, bracket 62 has the same configuration as bracket 44. More specifically, bracket 62, in some embodiments includes a shallow, u-shaped member 64, having two outer legs 64*a* coupled by a straight central section 64*b*. The u-shaped member 64 may be formed, for example, with bent, square steel tubing, or as a series of square tubes bent and welded in the shallow u-shape. The shallow u-shaped member 64 of bracket 62 is rigidly coupled to thigh panel 28, such as, for example, by bolts or screws. Bracket 62 also includes another u-shaped member 66, having two outer legs 66*a*, and inverted with respect to u-shaped member 64. U-shaped member 66 is coupled to u-shaped member 64 generally centered on central section 64*b* in the bottom of u-shaped member 64. U-shaped member 66 and u-shaped member 64 can be coupled together, in some embodiments, by welding to create bracket 62. The bottom center of u-shaped member 66 is coupled to a motor/actuator mount 68 that is, in turn, pivotally coupled to actuator 60. The configuration of foot cross member 20, actuator 60 and bracket 62 allows a shallow angle for the actuator 60 to better obscure actuator 60 from view when the adjustable bed 10 is used. Additionally, bracket 62 distributes the force of actuator 60 across thigh panel 28 more evenly than would a more-direct (not distributed) coupling of actuator 60 to thigh panel 28. In some embodiments, the width of bracket 62 is greater than one-third the width of, and approximately fifty percent the width of, thigh panel 28. While not shown, actuator 60 is coupled to a power supply and is typically controlled with some type of hand-held controller by the user, as would be understood by those of skill in the art. Additionally, the base 12 may include massage vibration in some embodiments, and may have a vibration motor (shown under a schematically depicted cover 70).

Figure 5:
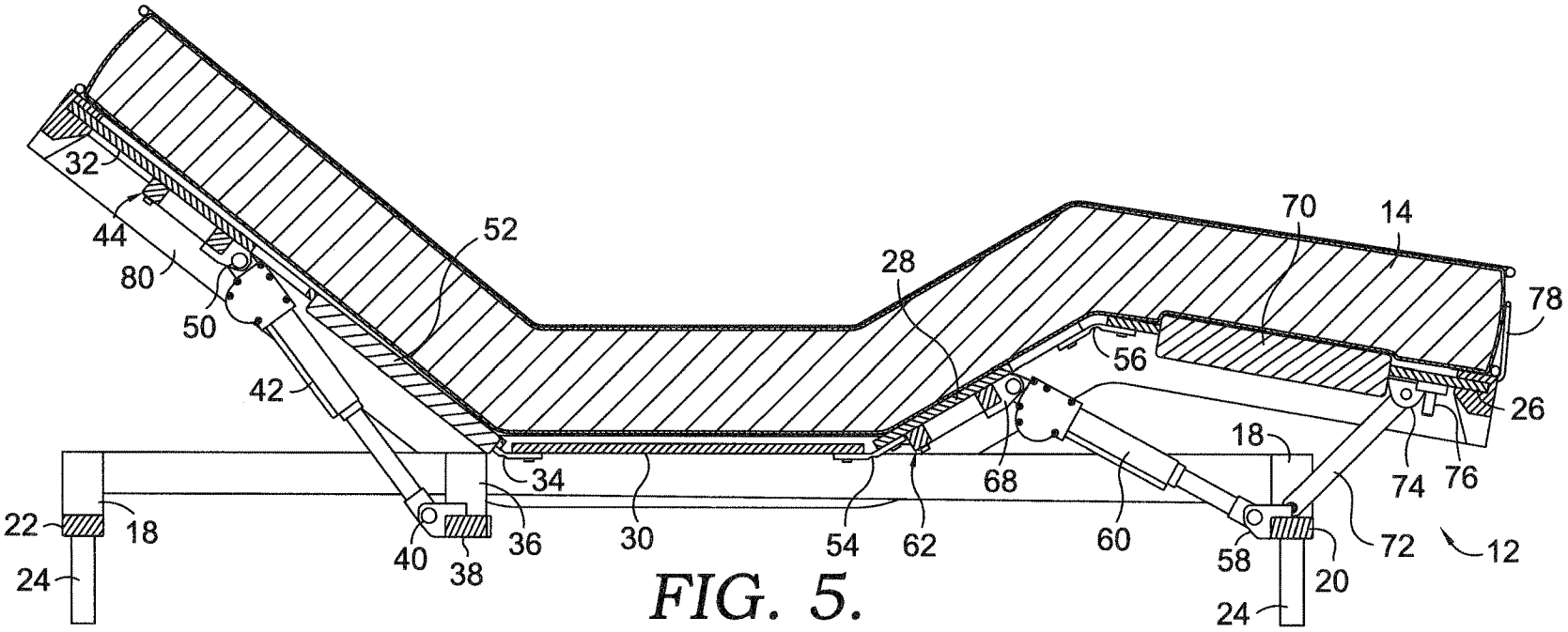
FIG. 5 is a cross-section of the adjustable bed of FIG. 2.

As best seen in FIGS. 3 and 5, a pair of support links 72 are pivotally coupled between the upright supports 18, under the foot cross member 20, and the foot panel 26. In some embodiments, a bracket 74 is coupled to foot panel 26 and is used to pivotally couple one end of the respective support link 72. The opposite end of support link 72 is pivotally coupled to a respective upright support 18 with a pin and bushing, for example. Support links 72 support the foot panel 26 as the thigh panel 28 and foot panel 26 are raised from a flat to a raised position by actuator 60.

In some embodiments, bracket 62 may be coupled to foot panel 26 (instead of thigh panel 28), with actuator 60 also reversed in orientation, to effectively apply the moving force to the foot panel 26, with the thigh panel 28 following movement of the foot panel 26.

In some embodiments, a pair of mattress retainer bushings 76 are coupled to foot panel 26, extending downwardly therefrom. The mattress retainer bushings 76 hold a mattress retainer 78 in place, as best seen in FIG. 5. As the adjustable bed 10 moves from a flat position, as shown in FIG. 4, to a raised position as shown in FIG. 5, the mattress retainer 78 maintains the position of mattress 14 with respect to panels 26-32.

Figure 4:
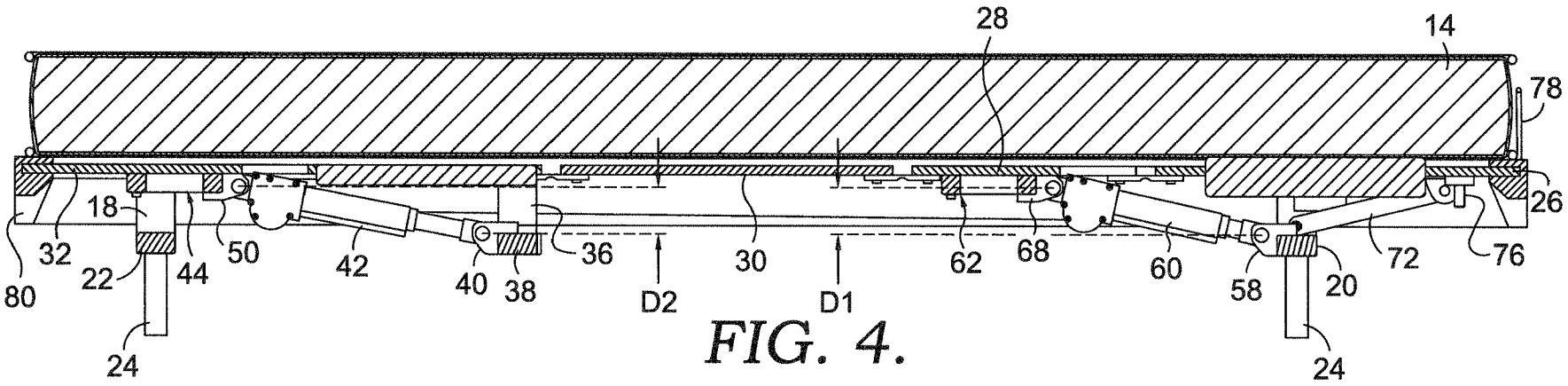
FIG. 4 is a cross-section of the adjustable bed of FIG. 1.

To move from the flat position of FIG. 4 to the raised position of FIG. 5, actuator 42 is activated, extending the shaft of the actuator 42 and increasing the distance between motor/actuator mount 40 and motor/actuator mount 50. The force of the actuator 42 is distributed across head panel 32 by bracket 44 allowing a smooth transition from the flat to the raised position, and allowing the angle of the actuator 42 to be more shallow that previous solutions. Similarly, to move from the flat position of FIG. 4 to the raised position of FIG. 5, actuator 60 is activated, extending the shaft of the actuator 60 and increasing the distance between motor/actuator mount 58 and motor/actuator mount 68. The force of the actuator 60 is distributed across thigh panel 28 by bracket 62 allowing a smooth transition from the flat to the raised position, and allowing the angle of the actuator 60 to be more shallow that previous solutions. In some embodiments, the distance (D1, see FIG. 4) from the center-line of motor/actuator mount 58 to the center-line of motor/actuator mount 68, in the flat position, is about 11 inches, but could vary in other embodiments and configurations. Similarly, the distance (D2, see FIG. 4) from the center-line of motor/actuator mount 40 to the center-line of motor/actuator mount 50 when the base 12 is in the flat position (see FIG. 4), about 13 inches (allowing greater movement), but could vary in other embodiments and configurations. Actuator 42 and actuator 60 are, in some embodiments, individually controllable, such that only head panel 32 is raised or only the foot panel 26 and thigh panel 28 are raised.

In some embodiments, the base 12 includes a shroud 80 that has a top edge 82 that is flush with the top of stationary panel 30, and may be coupled thereto. Shroud 80 can, in some embodiments, be made of an extruded foam material that follows the movement of the adjustable bed 10, as it is moved from the flat position to the raised position. Shroud 80 generally obscures from view the components under the panels 26-32 (such as the brackets 44, 62, the actuators 42, 60) when the bed 10 is in the flat position (see FIG. 4). In other embodiments, shroud 80 may be made from wood, or a composite material, for example that remains in place as the adjustable bed 10 moves. The shallow angle of actuators 42 and 60, allowed by brackets 44, 62, better obscure from view the components under the base 12.

Figure 6:
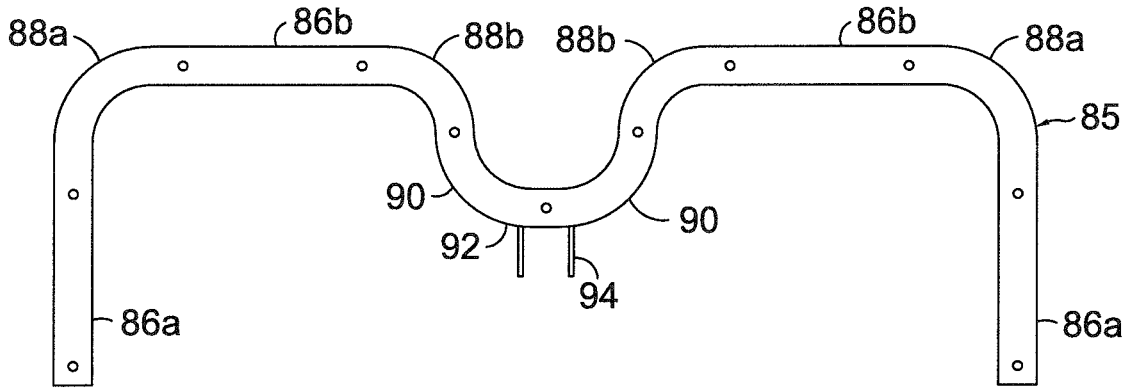
FIG. 6 is a top view of an alternative aspect of the bracket of FIGS. 3-5.

An alternate embodiment of bracket 44 or bracket 62 is shown in FIG. 6, and labeled as bracket 85. Bracket 85 is made of bent, square steel tubing, and is formed to somewhat combine the u-shape members (46, 48 for example) of bracket 44 into an integral one-piece solution. Bracket 85 thus has a general w-shape, with outer legs 86*a* transitioning through bends 88*a* to inward legs 86*b*. A central inward section 92 is formed by bends 88*b* and 90. Central inward section 92 has a motor/actuator mount 94 coupled in the middle for attachment to an actuator (either actuator 42 or 60, for example). Similar to brackets 44, 62, bracket 85 is preferably greater than one-third the width of the panel on which it is used (such as head panel 32 or thigh panel 28), and approximately one-half the width of the panel on which it is used. Bracket 85 could be used instead of either bracket 44, bracket 62, or both.

Figure 7:
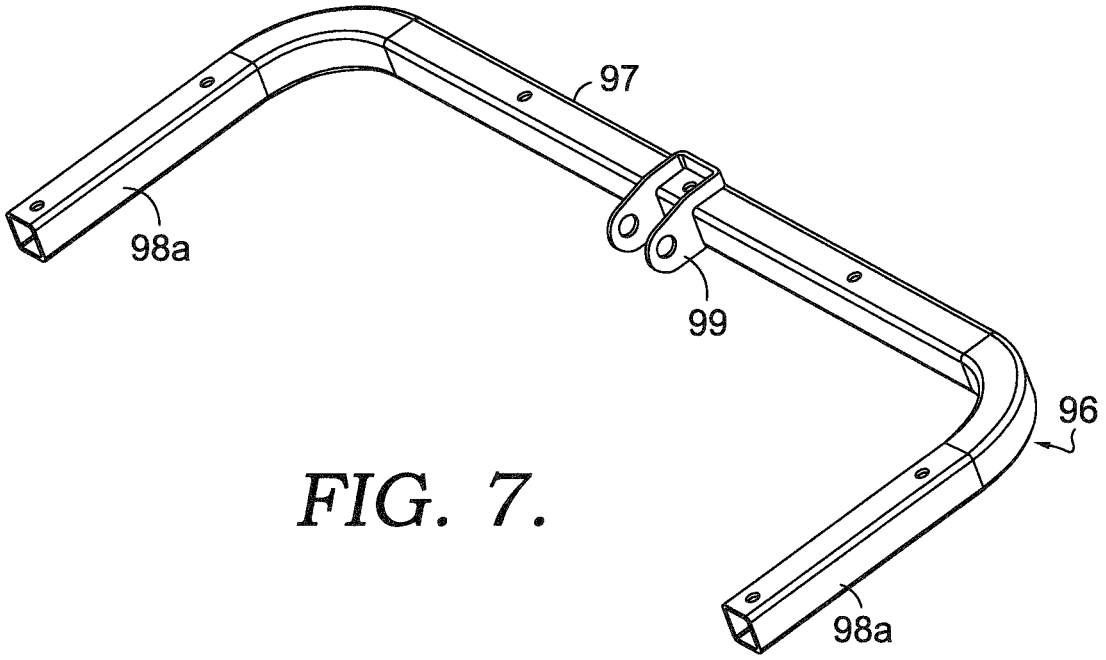
FIG. 7 is a view of another alternative aspect of the bracket of FIGS. 3-5.

Another alternate embodiment of bracket 44 or bracket 62 is shown in FIG. 7, and labeled as bracket 96. Bracket 96 is also preferably made of bent, square steel tubing, and is formed to utilize one of the u-shape members (such as 46 in bracket 44), while eliminating the other u-shape member (such as 48 in bracket 44), forming a lower-cost, simplified construction. Bracket 96 thus has a general u-shape, with outer legs 98*a* transitioning through bends to a central inward section 97. Central inward section 97 has a motor/actuator mount 99 coupled in the middle for attachment to an actuator (either actuator 42 or 60, for example). Similar to brackets 44, 62, and 85, bracket 97 is preferably greater than one-third the width of the panel on which it is used (such as head panel 32 or thigh panel 28), and approximately one-half the width of the panel on which it is used. Bracket 97 could be used instead of either bracket 44, bracket 62, or both, but in some embodiments, bracket 97 is used instead of bracket 44 on the head end of the adjustable bed 10, while one of the other brackets 62 or 85 is used on the foot end of the adjustable bed 10.

As used herein and in connection with the claims listed hereinafter, the terminology "any of clauses" or similar variations of said terminology is intended to be interpreted such that features of claims/clauses may be combined in any combination. For example, an exemplary clause 4 may indicate the method/apparatus of any of clauses 1 through 3, which is intended to be interpreted such that features of clause 1 and clause 4 may be combined, elements of clause 2 and clause 4 may be combined, elements of clause 3 and 4 may be combined, elements of clauses 1, 2, and 4 may be combined, elements of clauses 2, 3, and 4 may be combined, elements of clauses 1, 2, 3, and 4 may be combined, and/or other variations. Further, the terminology "any of clauses" or similar variations of said terminology is intended to include "any one of clauses" or other variations of such terminology, as indicated by some of the examples provided above.

The following clauses are aspects contemplated herein.

Clause 1. A bracket for use on a moveable panel of an adjustable bed, comprising: a first u-shaped member having a first leg separated from a second leg by a central section; and a second u-shaped member, inverted with respect to the first u-shaped member, and having first and second legs coupled to the central section of the first u-shaped member.

Clause 2. The bracket of any of the clauses, wherein the second u-shaped member has a bottom connecting the first and second legs, further comprising: a motor/actuator mount coupled to the bottom of the second u-shaped member.

Clause 3. The bracket of any of the clauses, wherein the motor/actuator mount has a mounting hole with a center line, and wherein the center line of the motor/actuator mount mounting hole extends in the same plane as the second u-shaped member.

Clause 4. The bracket of any of the clauses, wherein the first u-shape member has a width that is greater than one-third the width of the panel on which it is used.

Clause 5. An adjustable bed base, comprising: a stationary base; a head panel moveable with respect to the stationary base; a head bracket coupled to the head panel, the head bracket comprising a first u-shaped member having a first leg separated from a second leg by a central section; and a second u-shaped member, inverted with respect to the first u-shaped member, and having a first leg coupled to the central section of the first u-shaped member and a second leg coupled to the central section of the first u-shaped member.

Clause 6. The adjustable bed base of any of the clauses, further comprising an actuator coupled between the stationary base and the head bracket.

Clause 7. The adjustable bed base of any of the clauses, wherein the actuator has a first end pivotally coupled to the stationary base and a second end pivotally coupled to the head bracket.

Clause 8. The adjustable bed base of any of the clauses, further comprising a stationary panel coupled to the stationary base adjacent the head panel and having a first edge and a second edge, and wherein the first edge is pivotally coupled to the head panel.

Clause 9. The adjustable bed base of any of the clauses, further comprising a thigh panel having a first edge and a second edge, wherein the thigh panel first edge is pivotally coupled to the second edge of the stationary panel; and a foot panel pivotally coupled to the second edge of the thigh panel.

Clause 10. The adjustable bed base of any of the clauses, further comprising: a thigh bracket coupled to the thigh panel, the thigh bracket comprising a first u-shaped member having a first leg separated from a second leg by a central section; and a second u-shaped member, inverted with respect to the first u-shaped member, and having a first leg coupled to the central section of the first u-shaped member and a second leg coupled to the central section of the first u-shaped member.

Clause 11. A bracket for use on a moveable panel of an adjustable bed, the moveable panel having a first width, the bracket comprising: a w-shaped member having a second width, wherein the second width is greater than one-third the first width.

Clause 12. The bracket of any of the clauses, wherein the w-shaped bracket has two lower transition areas and one upper transition area, and wherein the two lower transition areas and the upper transition area each have a smooth radius without corners.

Clause 13. The bracket of any of the clauses, wherein the w-shaped bracket is made from one piece of bent, square steel tubing.

Clause 14. The bracket of any of the clauses, further comprising a motor/actuator mount rigidly coupled to a middle portion of the upper transition area.

Clause 15. The bracket of any of the clauses, wherein the motor/actuator mount has a mounting hole with a center line, and wherein the center line of the motor/actuator mount mounting hole extends in the same plane as the w-shaped bracket.

Clause 16. A bracket for use on a moveable panel of an adjustable bed, the moveable panel having a first width, the bracket comprising a u-shaped member having a second width, wherein the second width is greater than one-third the first width.

Clause 17. The bracket of any of the clauses, wherein the u-shaped bracket is made from one piece of bent, square steel tubing.

Clause 18. The bracket of any of the clauses, wherein the u-shape has two outer legs separated by a central inward section, the bracket further comprising a motor/actuator mount rigidly coupled to a middle portion of the central inward section.

Clause 19. The bracket of any of the clauses, wherein the motor/actuator mount has a mounting hole with a center line, and wherein the center line of the motor/actuator mount mounting hole extends in the same plane as the u-shaped bracket.

From the foregoing, it will be seen that this invention is one well adapted to attain all the ends and objects hereinabove set forth together with other advantages, which are obvious and inherent to the structure. It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matter herein set forth or shown in the accompanying drawings is to be interpreted as illustrative and not in a limiting sense.

The invention claimed is:

1. A w-shaped bracket for use on a moveable panel of an adjustable bed, comprising:

a pair of outer legs and a pair of inner legs, wherein the pair of inner legs are coupled to the pair of outer legs by transitioning through a first plurality of bends, wherein each of the first plurality of bends is generally orthogonal;

wherein the w-shaped bracket is formed of a single piece of material extending continuously between the pair of outer legs; and wherein each of the pair of inner legs are coupled together by a central inward section having a second plurality of bends, and wherein each of the second plurality of bends is generally orthogonal.

2. The w-shaped bracket of claim 1, further comprising: a motor/actuator mount coupled to central inward section of the w-shaped bracket.

3. The w-shaped bracket of claim 2, wherein the motor/actuator mount has a mounting hole with a center line, and wherein the center line of the motor/actuator mount mounting hole extends in the same plane as the central inward section of the w-shaped bracket.

4. The w-shaped bracket of claim 1, wherein the moveable panel has a first width and the w-shaped bracket has a second width, wherein the second width is greater than one-third of the first width.

5. A bracket for use on a moveable panel of an adjustable bed, the moveable panel having a first width, the bracket comprising: a w-shaped member having a second width, wherein the second width is greater than one-third the first width; wherein the w-shaped member is formed of a single piece of material extending continuously between a pair of outer legs; and wherein the w-shaped member includes a plurality of bends, wherein each of the plurality of bends is generally orthogonally-shaped.

6. The bracket of claim 5, wherein the w-shaped member has two lower transition areas and an upper transition area, and wherein the two lower transition areas and the upper transition area each have a smooth radius without corners.

7. The bracket of claim 6, wherein the w-shaped member is made from one piece of bent, square steel tubing.

8. The bracket of claim 7, further comprising a motor/actuator mount rigidly coupled to a middle portion of the one upper transition area.

9. The bracket of claim 8, wherein the motor/actuator mount has a mounting hole with a center line, and wherein the center line of the motor/actuator mount mounting hole extends in the same plane as the w-shaped member.

10. A w-shaped bracket for use on a moveable panel of an adjustable bed, the moveable panel having a first width, the w-shaped bracket comprising: two lower transition areas and an upper transition area, and wherein the two lower transition areas and the upper transition area each have a smooth radius without corners, and wherein each smooth radius without corners is generally orthogonally-shaped; and wherein the w-shaped bracket is formed of a single piece of material extending continuously between a pair of outer legs.

11. The w-shaped bracket of claim 10, wherein the w-shaped bracket is made from one piece of bent, square steel tubing.

12. The w-shaped bracket of claim 11, wherein the w-shaped bracket has two outer legs separated by a central inward section, the w-shaped bracket further comprising a motor/actuator mount rigidly coupled to a middle portion of the central inward section.

13. The w-shaped bracket of claim 12, wherein the motor/actuator mount has a mounting hole with a center line, and wherein the center line of the motor/actuator mount mounting hole extends in the same plane as the w-shaped bracket.

* * * * *